US010863271B2

(12) United States Patent
Itoyama et al.

(10) Patent No.: US 10,863,271 B2
(45) Date of Patent: Dec. 8, 2020

(54) ACOUSTIC SIGNAL PROCESSING DEVICE, ACOUSTIC SIGNAL PROCESSING METHOD, AND PROGRAM

(71) Applicant: HONDA MOTOR CO., LTD., Tokyo (JP)

(72) Inventors: Katsutoshi Itoyama, Tokyo (JP); Kazuhiro Nakadai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/553,870

(22) Filed: Aug. 28, 2019

(65) Prior Publication Data

US 2020/0077187 A1 Mar. 5, 2020

(30) Foreign Application Priority Data

Sep. 4, 2018 (JP) ..... 2018-165504

(51) Int. Cl.
*H04R 3/00* (2006.01)
*H04R 29/00* (2006.01)
*H04R 1/40* (2006.01)

(52) U.S. Cl.
CPC ..... *H04R 3/005* (2013.01); *H04R 1/406* (2013.01); *H04R 29/005* (2013.01)

(58) Field of Classification Search
CPC ..... H04R 3/005; H04R 1/406; H04R 29/005
USPC ..... 381/92
See application file for complete search history.

(56) References Cited

PUBLICATIONS

Itoyama, Katsutoshi and Nakadai, Kazuhiro, "Synchronization between channels of a plurality of A/D converters based on probabilistic generation model," Proceedings of the 2018 Spring Conference, Acoustical Society of Japan, 2018, pp. 505-508 (Year: 2018).*
Itoyama, Katsutoshi and Nakadai, Kazuhiro, Synchronization of multiple A/D converters based on a statistical generative model*, 2018, pp. 505-508, discussed in specification, English translation included, 15 pages.

* cited by examiner

*Primary Examiner* — Paul Kim
(74) *Attorney, Agent, or Firm* — Rankin, Hill & Clark LLP

(57) ABSTRACT

An acoustic signal processing device includes an acoustic signal processing unit configured to calculate a spectrum of each acoustic signal and a steering vector having m elements on the basis of m acoustic signals converted into m digital signals by sampling m analog signals representing sounds collected by m microphones (m is an integer of 1 or more and M or less, and M is an integer of 2 or more), and to estimate a sampling frequency $\omega_m$ in the sampling on the basis of the spectrum, the steering vector, and a sampling frequency $\omega_{ideal}$ that is a predetermined value.

4 Claims, 13 Drawing Sheets

ACOUSTIC SIGNAL PROCESSING DEVICE, ACOUSTIC SIGNAL PROCESSING METHOD, AND PROGRAM

CROSS-REFERENCE TO RELATED APPLICATION

Priority is claimed on Japanese Patent Application No. 2018-165504, filed Sep. 4, 2018, the content of which is incorporated herein by reference.

BACKGROUND

Field of the Invention

The present invention relates to an acoustic signal processing device, an acoustic signal processing method, and a program.

Related Art

Conventionally, there is a technology of collecting sounds using a plurality of microphones and acquiring identification of a sound source on the basis of the collected sounds and information based on the collected sounds. In such a technology, the sounds collected by the microphones are converted into sampled electrical signals, signal processing is executed on the converted electrical signals, and thereby the information based on the collected sounds is acquired. In addition, signal processing in such a technology is processing in which the converted electrical signals are assumed to be electrical signals obtained by sampling sounds collected by microphones located at different positions at the same sampling frequency (for example, refer to Katsutoshi Itoyama, Kazuhiro Nakadai, "Synchronization between channels of a plurality of A/D converters based on probabilistic generation model," Proceedings of the 2018 Spring Conference, Acoustical Society of Japan, 2018, pp. 505-508).

However, in practice, an AD converter provided for each microphone samples the converted electrical signals in synchronization with a clock generated by a vibrator provided for each AD converter. For this reason, there are cases in which sampling at the same sampling frequency is not necessarily performed depending on individual differences of the vibrators. In addition, in robots or the like which operate in extreme environments, external influences such as temperature or humidity are different for each vibrator. For this reason, in this case, not only the individual differences of each vibrator but also the external influences may cause a gap in a clock of each vibrator. To reduce such a gap, it has been proposed to use an oven-controlled crystal oscillator (OCXO), an oscillator with small individual difference such as an atomic clock, a large capacity capacitor, or the like. However, it is not realistic to actually mount it on a robot or the like and to operate it. Therefore, in such conventional technologies, accuracy of information based on sounds collected by a plurality of microphones may deteriorate in some cases.

SUMMARY OF THE INVENTION

Aspects of the present invention have been made in view of the above circumstances, and an object thereof is to provide an acoustic signal processing device, an acoustic signal processing method, and a computer program which can suppress deterioration in accuracy of information based on sounds collected by a plurality of microphones.

In order to solve the above problems, the present invention adopts the following aspects.

(1) An acoustic signal processing device according to one aspect of the present invention includes an acoustic signal processing unit configured to calculate a spectrum of each acoustic signal and a steering vector having m elements on the basis of m acoustic signals converted into m digital signals by sampling m analog signals representing sounds collected by m microphones (m is an integer of 1 or more and M or less, and M is an integer of 2 or more), and to estimate a sampling frequency $\omega_m$ in the sampling on the basis of the spectrum, the steering vector, and a sampling frequency $\omega_{ideal}$ that is a predetermined value.

(2) In the aspect (1) described above, the steering vector may represent a difference between positions of the microphones having a transfer characteristic from a sound source of the sounds to each of the microphones.

(3) In the aspect (1) or (2) described above, a matrix representing a conversion of an analog signal from a spectrum of an ideal signal into a spectrum of a signal sampled at the sampling frequency $\omega_m$ and a sample time $\tau_m$ is set to a spectrum expansion matrix, and the acoustic signal processing unit may estimate the sampling frequency $\omega_m$ on the basis of the steering vector, the spectrum expansion matrix, and a spectrum $X_m$.

(4) An acoustic signal processing method according to another aspect of the present invention includes a spectrum calculation step of calculating a spectrum of each acoustic signal on the basis of m acoustic signals converted into m digital signals by sampling m analog signals representing sounds collected by m microphones (m is an integer of 1 or more and M or less, and M is an integer of 2 or more), a steering vector calculation step of calculating a steering vector having m elements on the basis of the m converted acoustic signals, and an estimation step of estimating a sampling frequency $\omega_m$ in the sampling on the basis of the spectrum, the steering vector, and a sampling frequency $\omega_{ideal}$ that is a predetermined value.

(5) A computer readable non-transitory storage medium according to still another aspect of the present invention stores a program causing a computer of an acoustic signal processing device to execute a spectrum calculation step of calculating a spectrum of each acoustic signal on the basis of m acoustic signals converted into m digital signals by sampling m analog signals representing sounds collected by m microphones (m is an integer of 1 or more and M or less, and M is an integer of 2 or more), a steering vector calculation step of calculating a steering vector having m elements on the basis of the m converted acoustic signals, and an estimation step of estimating a sampling frequency $\omega_m$ in the sampling on the basis of the spectrum, the steering vector, and a sampling frequency $\omega_{ideal}$ that is a predetermined value.

According to the aspects (1), (4), and (5), it is possible to synchronize a plurality of acoustic signals having different sampling frequencies. For this reason, according to the aspects (1), (4), and (5), it is possible to suppress deterioration in accuracy of information based on sounds collected by a plurality of microphones.

According to the aspect (2) described above, it is possible to include a distance difference of a microphone from a sound source, a direct sound, and a reflected sound.

According to the aspect (3) described above, it is possible to correct a gap between sampling frequencies $\omega_m$ and $\omega_{ideal}$.

DETAILED DESCRIPTION OF THE INVENTION

Figure 1:
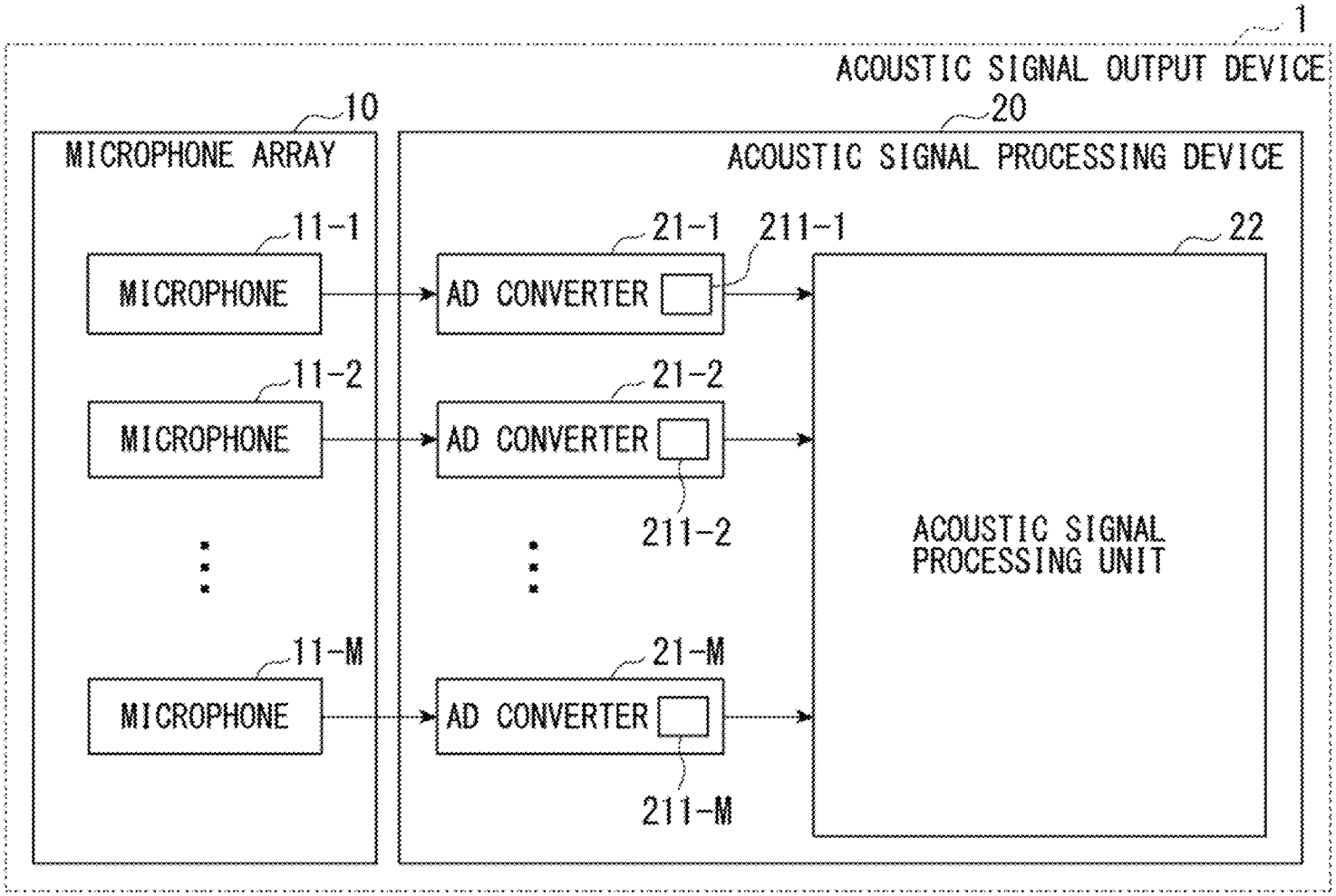
FIG. 1 is a diagram which shows an example of a configuration of an acoustic signal output device 1 of an embodiment.

FIG. 1 is a diagram which shows an example of a configuration of an acoustic signal output device 1 of an embodiment. The acoustic signal output device 1 includes a microphone array 10 and an acoustic signal processing device 20. The microphone array 10 includes microphones 11-*m* (m is an integer of 1 or more and M or less; M is an integer of 2 or more). The microphones 11-*m* are located at different positions. The microphones 11-*m* collect a sound $Z1_m$ which has arrived at the microphones 11-*m*. The sound $Z1_m$ arriving at the microphones 11-*m* includes, for example, a direct sound that is emitted by a sound source and an indirect sound that arrives after being reflected, absorbed, or scattered by a wall or the like. For this reason, a frequency spectrum of a sound source and a frequency spectrum of a sound collected by the microphones 11-*m* are not necessarily the same.

The microphones 11-*m* convert the collected sound $Z1_m$ into an acoustic signal such as an electrical signal or an optical signal. The converted electrical signal or optical signal is an analog signal $Z2_m$ which represents a relationship between a magnitude of the collected sound and a time at which the sound is collected. That is, the analog signal $Z2_m$ represents a waveform in a time domain of the collected sound.

The microphone array 10 which includes m microphones 11-*m* outputs acoustic signals of M channels to the acoustic signal processing device 20.

The acoustic signal processing device 20 includes, for example, a central processing unit (CPU), a memory, an auxiliary storage device, and the like connected by a bus, and executes a program. The acoustic signal processing device 20 functions as a device including, for example, an analog to digital (AD) converter 21-1, an AD converter 21-2, . . . , an AD converter 21-M, an acoustic signal processing unit 22, and an ideal signal conversion unit 23 according to execution of a program. The acoustic signal processing device 20 acquires the acoustic signals of M channels from the microphone array 10, estimates the sampling frequency $\omega_m$ when an acoustic signal collected by the microphones 11-*m* is converted into a digital signal, and calculates an acoustic signal resampled at a virtual sampling frequency $\omega_{ideal}$ using an estimated sampling frequency $\omega_m$.

The AD converter 21-*m* is included in each of the microphones 11-*m* and acquires the analog signal $Z2_m$ output by the microphones 11-*m*. The AD converter 21-*m* samples the acquired analog signal $Z2_m$ at the sampling frequency $\omega_m$ in the time domain. Hereinafter, a signal representing a waveform after execution of the sampling is referred to as a time domain digital signal $Yall_m$. Hereinafter, a signal in one frame, which is part of the time domain digital signal $Yall_m$, is referred to as a single frame time domain digital signal $Y_m$ to simplify the description. Hereinafter, a $g^{th}$ frame arranged in a time order is referred to as a frame g. Hereinafter, it is assumed that the frame is a frame g to simplify the description.

The single frame time domain digital signal $Y_m$ is represented by the following expression (1).

$$Y_m=(y_{m,0},y_{m,1},\ldots,y_{m,L-1})^T \tag{1}$$

$y_m$, ξ is a $(\xi+1)^{th}$ element of the single frame time domain digital signal Ym. ξ is an integer of 0 or more and (L−1) or less. The element $y_m$, ξ is a magnitude of sound represented by the single frame time domain digital signal $Y_m$, and is a magnitude of sound at a $\xi^{th}$ time after the execution of the sampling, which is a time in one frame. Note that T in Expression (1) represents a transposition of a vector. Hereinafter, T in an expression like Expression (1) represents a transposition of a vector. Note that, L is a signal length of the single frame time domain digital signal $Y_m$.

The AD converter 21-*m* (analog to digital converter) includes a vibrator 211-*m*. The AD converter 21-*m* operates in synchronization with a sampling frequency generated by the vibrator 211-*m*.

The acoustic signal processing unit 22 acquires a sampling frequency $\omega_m$ and a sample time $\tau_m$. The acoustic signal processing unit 22 converts a time domain digital signal $Yall_m$ into an ideal signal to be described below on the basis of the acquired sampling frequency $\omega_m$ and sample time $\tau_m$.

Note that the sample time $\tau_m$ is a start time for the AD converter 21-*m* to start sampling of the analog signal $Z2_m$. The sample time $\tau_m$ is a time difference which represents a gap between an initial phase of sampling by the AD converter 21-*m* and a phase serving as a predetermined reference.

Here, a sampling frequency generated by a vibrator will be described.

Since there are individual differences in respective vibrators 211-*m* and environmental influences such as heat or humidity for respective vibrators 211-*m* are not necessarily the same, sampling frequencies generated by respective vibrators 211-*m* are not necessarily the same in all of the vibrators 211-*m*. For this reason, all of the sampling frequencies ωm are not necessarily the same sampling frequency $\omega_{ideal}$.

Hereinafter, a virtual sampling frequency of the vibrator 211-*m* is referred to as the virtual frequency $\omega_{ideal}$. Note that a variation in sampling frequency generated by each of M vibrators 211-*m* is near a variation in reference transmission frequency of the vibrators 211-*m*, and a nominal frequency is, for example, about $\times 10^{-6} \pm 20\%$ with respect to 16 kHz.

In addition, since the sampling frequencies generated by the vibrators 211-*m* are not necessarily the same in all of the vibrators 211-*m*, not all sample times $\tau_m$ are necessarily the same time.

Hereinafter, a sample time in a case in which there are no individual differences between the vibrators 211-*m* and no environmental influences such as heat or humidity with respect to the vibrators 211-*m* is referred to as a virtual time $\tau_{ideal}$.

In this manner, respective sampling frequencies $\omega_m$ are not necessarily the same, and respective sample times $\tau_m$ are not necessarily the same. In addition, the microphones 11-*m* are not positioned at the same position. For this reason, each single frame time domain digital signal $Y_m$ is not necessarily the same as an ideal signal. An ideal signal is a signal obtained by sampling the analog signal $Z2_m$ at the virtual frequency $\omega_{ideal}$ and the virtual time $\tau_{ideal}$.

Figure 2:
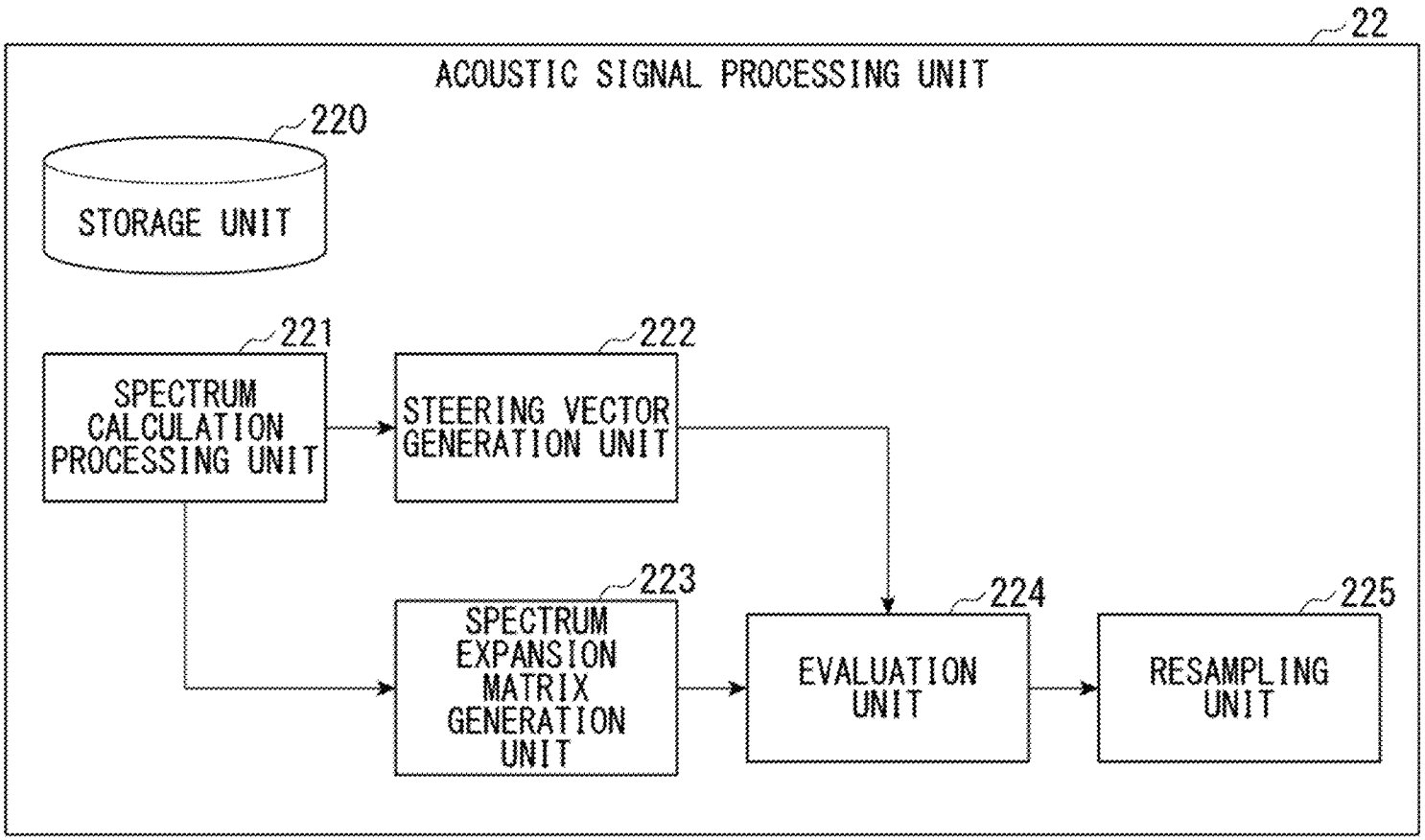
FIG. 2 is a diagram which shows an example of a functional configuration of an acoustic signal processing device 20 in the embodiment.

FIG. 2 is a diagram which shows an example of a functional configuration of the acoustic signal processing unit 22 in the embodiment.

The acoustic signal processing unit 22 includes a storage unit 220, a spectrum calculation processing unit 221, a steering vector generation unit 222, a spectrum expansion matrix generation unit 223, an evaluation unit 224, and a resampling unit 225.

The storage unit 220 is configured using a storage device such as a magnetic hard disk device or a semiconductor storage device. The storage unit 220 stores the virtual frequency $\omega_{ideal}$, the virtual time $\tau_{ideal}$, the trial frequency $\omega_m$, and the trial time $T_m$. The virtual frequency $\omega_{ideal}$ and the virtual time $\tau_{ideal}$ are known values stored in the storage unit 220 in advance. The trial frequency $W_m$ is a value that is updated according to an evaluation result of the evaluation unit 224 to be described below and is a value of a physical quantity having the same dimension as the sampling frequency $\omega_m$. The trial frequency $W_m$ is a predetermined initial value until it is updated according to the evaluation result of the evaluation unit 224. The trial time $T_m$ is a value that is updated according to the evaluation result of the evaluation unit 224 to be described below and is a value of a physical quantity having the same dimension as the sample time $\tau_m$. The trial time $T_m$ is a predetermined initial value until it is updated according to the evaluation result of the evaluation unit 224.

Note that, as an example, when the virtual frequency $\omega_{ideal}$ is 16000 Hz, a trial frequency $W_1$ is 15950 Hz, a trial time $\tau_1$ is 0 msec, a trial frequency $W_2$ is 15980 Hz, a trial time $\tau_2$ is 0 msec, a trial frequency $W_3$ is 16020 Hz, a trial time $\tau_3$ is 0 msec, a trial frequency $W_4$ is 16050 Hz, a trial time $\tau_4$ is 0 msec, and the like.

Note that the acoustic signal processing unit 22 performs processing on an acquired acoustic signal, for example, for every length L.

The spectrum calculation processing unit 221 acquires an acoustic signal output by the AD converter 21 and calculates a spectrum by performing a Fourier transform on the acquired acoustic signal. The spectrum calculation processing unit 221 acquires a spectrum of a waveform represented by a single frame time domain digital signal $Y_m$ for all frames.

The spectrum calculation processing unit 221 acquires, for example, first, a time domain digital signal $Yall_m$ for each frame. Next, the spectrum calculation processing unit 221 acquires a spectrum $X_m$ of the single frame time domain digital signal $Y_m$ in the frame g by performing a discrete Fourier transform on the single frame time domain digital signal $Y_m$ for each frame g.

Since the spectrum $X_m$ is a Fourier component of the digital signal $Y_m$, the following expression (2) is established between the spectrum $X_m$ and the digital signal $Y_m$.

$$X_m = DY_m \tag{2}$$

In Expression (2), D is a matrix of L rows and L columns. An element D_<$j_x$,$j_y$> ($j_x$ and $j_y$ are integers of 1 or more and L of less) at row $j_x$ and column $j_y$ of the matrix D is represented by the following expression (3). Hereinafter, D is referred to as a discrete Fourier transform matrix.

$X_m$ is a vector having L elements. In Expression (3), i represents an imaginary unit.

Note that an underscore represents that a letter or number to the right of the underscore is a subscript of a letter or number to the left of the underscore. For example, j_x represents $j_x$.

Note that < . . . > to the left of an underscore represents that the letters or numbers in < . . . > are a subscript of a letter or number to the right of the underscore. For example, y_<n,ξ> represents $y_{n,\xi}$.

$$D_{j_x,j_y} = \frac{1}{\sqrt{L}} e^{-\frac{2\pi i(j_x-1)(j_y-1)}{L}} \tag{3}$$

The steering vector generation unit 222 generates a steering vector for each microphone 11-*m* on the basis of the spectrum $X_m$. A steering vector is a vector having a transfer function from a microphone to a sound source as an element. The steering vector generation unit 222 may also generate a steering vector in a known manner.

The steering vector represents a difference between positions of the microphones 11-*m* having a transfer characteristic from the sound source to each of the microphones 11-*m*. The positions of the microphones 11-*m* are positions at which the microphones 11-*m* collect sounds.

The spectrum expansion matrix generation unit 223 acquires the trial frequency $W_m$ and the trial time $T_m$ stored in the storage unit 220, and generates a spectrum expansion matrix on the basis of the acquired trial frequency $W_m$ and trial time $T_m$. A spectrum expansion matrix is a matrix representing a conversion from a frequency spectrum of an ideal signal into a frequency spectrum of a signal obtained by sampling the analog signal $Z2_m$ at the sampling frequency $W_m$ and the sampling time $T_m$.

The evaluation unit 224 determines whether the trial frequency $W_m$ and the trial time $T_m$ satisfy a predetermined condition (hereinafter referred to as an "evaluation condition") on the basis of the steering vector, the spectrum expansion matrix, and the spectrum $X_m$.

Note that an evaluation condition is a condition based on the steering vector, the spectrum expansion matrix, and the spectrum $X_m$. The evaluation condition is, for example, a condition of satisfying Expression (21) described below.

The evaluation condition may be any other condition as long as all values obtained by multiplying the spectrum $X_m$ by an inverse matrix of the spectrum expansion matrix, and dividing each element value of a vector of a result of the multiplication by an element value of the steering vector are values within a predetermined range.

The evaluation unit 224 determines the trial frequency $W_m$ as the sampling frequency $\omega_m$ and determines the trial time $T_m$ as the sample time $\tau_m$ when the trial frequency $W_m$ and the trial time $T_m$ satisfy the evaluation condition.

The evaluation unit 224 updates the trial frequency $W_m$ and the trial time $T_m$ using, for example, a Metropolis algorithm when the trial frequency $W_m$ and the trial time $T_m$ do not satisfy the evaluation condition. A method of updating, by the evaluation unit 224, the trial frequency $W_m$ and the trial time $T_m$ is not limited thereto, and any algorithm such as a Monte Carlo method and the like may be used.

The resampling unit 225 converts the time domain digital signal $Yall_m$ into an ideal signal on the basis of the sampling frequency $\omega_m$ and sample time $\tau_m$ determined by the evaluation unit 224.

Figure 3:
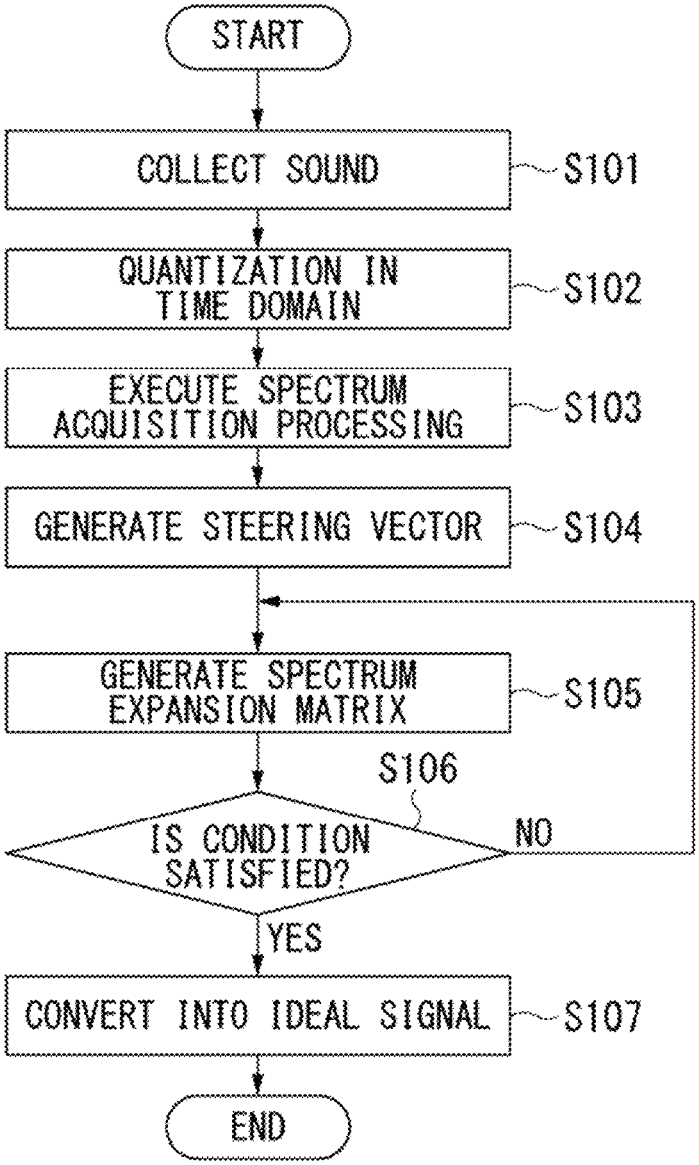
FIG. 3 is a flowchart which shows an example of a flow of processing executed by the acoustic signal output device 1 of the embodiment.

FIG. 3 is a flowchart which shows an example of a flow of processing executed by the acoustic signal output device 1 of the embodiment.

Each microphone 11-*m* collects a sound and converts the collected sound into an electrical signal or an optical signal (step S101).

The AD converter 21-*m* samples a time domain digital signal $Yall_m$ which is the electrical signal or optical signal converted in step S101 using the frequency $\omega_m$ in the time domain (step S102).

The spectrum calculation processing unit 221 calculates a spectrum (step S103).

The steering vector generation unit 222 generates a steering vector for each microphone 11-*m* on the basis of the spectrum $X_m$ (step S104).

The spectrum expansion matrix generation unit 223 acquires a trial frequency $W_m$ and a trial time $T_m$ stored in the storage unit 220, and generates a spectrum expansion matrix on the basis of the acquired trial frequency $W_m$ and trial time $T_m$ (step S105).

The evaluation unit 224 determines whether the trial frequency $W_m$ and the trial time $T_m$ satisfy the evaluation condition on the basis of the steering vector, the spectrum expansion matrix, and the spectrum $X_m$ (step S106).

When the trial frequency $W_m$ and the trial time $T_m$ satisfy the evaluation condition (YES in step S106), the evaluation unit 224 determines the trial frequency $W_m$ as the sampling frequency $\omega_m$, and determines the trial time $T_m$ as the sample time $\tau_m$. Next, the resampling unit 225 converts the time domain digital signal $Yall_m$ into an ideal signal on the basis of the sampling frequency $\omega_m$ and the sample time $\tau_m$ determined by the evaluation unit 224.

On the other hand, when the trial frequency $W_m$ and the trial time $T_m$ do not satisfy the evaluation condition (No in step S106), values of the trial frequency $W_m$ and the trial time $T_m$ are updated.

Note that, in the processing from step S105 to S106, a spectrum expansion matrix is generated on the basis of the trial frequency $W_m$ and the trial time $T_m$, and other processing may be used as long as it is based on an optimization algorithm for determining the sampling frequency $\omega_m$ and the sample time $\tau_m$ which satisfy the evaluation condition on the basis of the spectrum expansion matrix and the steering vector.

The optimization algorithm may also be another algorithm. The optimization algorithm may be, for example, a gradient descent method. In addition, the optimization algorithm may be, for example, a Metropolis algorithm. A Metropolis algorithm is one simulation method and is a kind of Monte Carlo method.

The acoustic signal output device 1 configured in this manner estimates the sampling frequency $\omega_m$ and the sample time $\tau_m$ on the basis of the spectrum expansion matrix and the steering vector and converts the time domain digital signal $Yall_m$ into an ideal signal on the basis of the estimated sampling frequency $\omega_m$ and sample time $\tau_m$. For this reason, the acoustic signal output device 1 configured in this manner can suppress deterioration in accuracy of information based on sounds collected by a plurality of microphones.

Application Example

Figure 4:
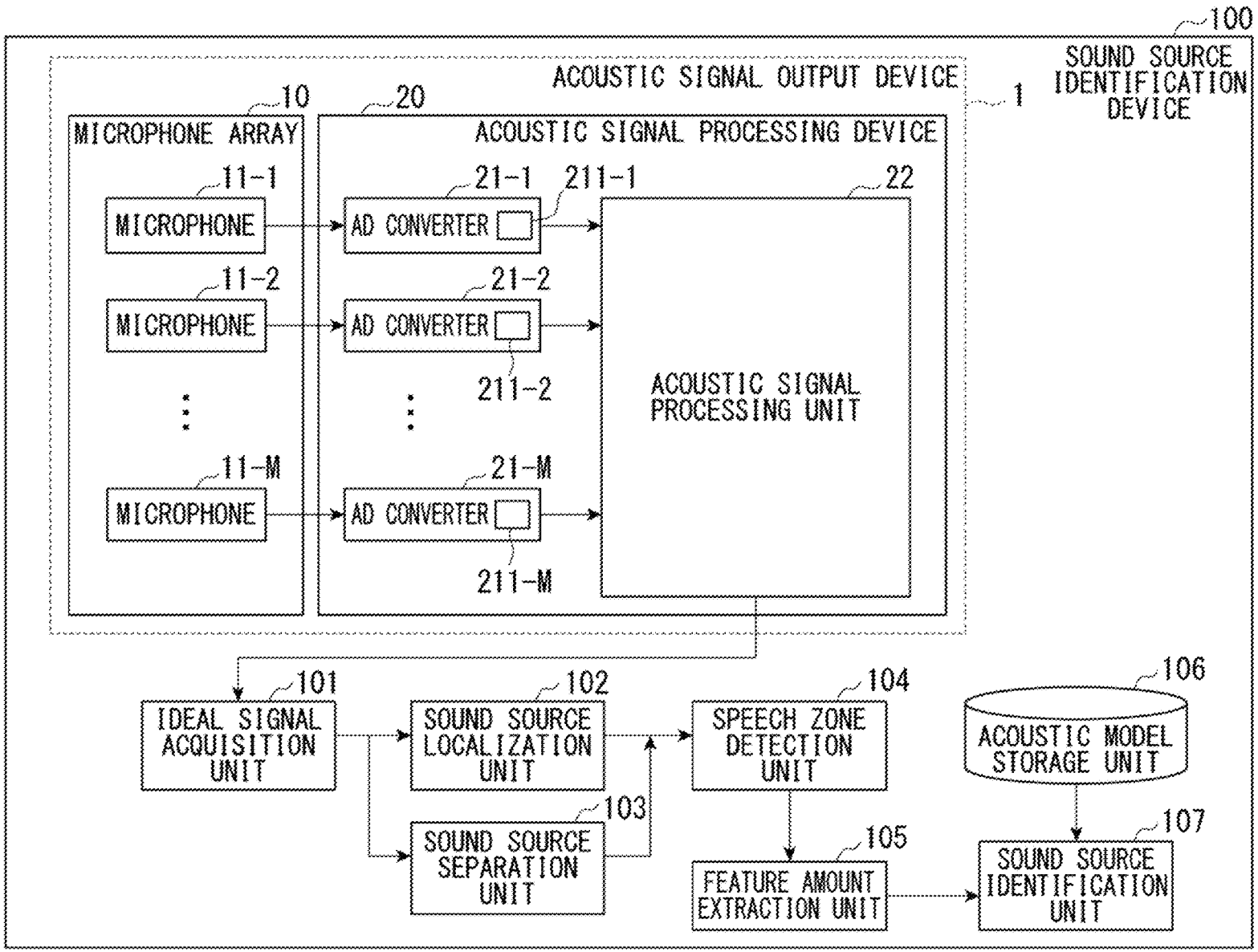
FIG. 4 is a diagram which shows an application example of the acoustic signal output device 1 of the embodiment.

FIG. 4 is a diagram which shows an application example of the acoustic signal output device 1 of the embodiment. FIG. 4 shows a sound source identification device 100 which is an application example of the acoustic signal output device 1.

The sound source identification device 100 includes, for example, a CPU, a memory, an auxiliary storage device, and the like connected by a bus and executes a program. The sound source identification device 100 functions as a device including the acoustic signal output device 1, an ideal signal acquisition unit 101, a sound source localization unit 102, a sound source separation unit 103, a speech zone detection unit 104, a feature amount extraction unit 105, an acoustic model storage unit 106, and a sound source identification unit 107 by executing the program.

Hereinafter, components having the same function as in FIG. 1 will be denoted by the same reference numerals and description thereof will be omitted.

Hereinafter, it is assumed that there are a plurality of sound sources to simplify the description.

The ideal signal acquisition unit 101 acquires ideal signals of M channels which are converted by the acoustic signal processing unit 22 and outputs the acquired ideal signals of the M channels to the sound source localization unit 102 and the sound source separation unit 103.

The sound source localization unit 102 determines a direction in which the sound sources are located (sound source localization) on the basis of the ideal signals of the M channels output by the ideal signal acquisition unit 101. The sound source localization unit 102 determines, for example, a direction in which each sound source is located for each frame of a predetermined length (for example, 20 ms). The sound source localization unit 102 calculates, for example, a spatial spectrum indicating power in each direction using a multiple signal classification (MUSIC) method in sound source localization. The sound source localization unit 102 determines a sound source direction for each sound source on the basis of the spatial spectrum. The sound source localization unit 102 outputs sound source direction information indicating a sound source direction to the sound source separation unit 103 and the speech zone detection unit 104.

The sound source separation unit 103 acquires the sound source direction information output by the sound source localization unit 102 and the ideal signals of the M channels output by the ideal signal acquisition unit 101. The sound source separation unit 103 separates the ideal signals of the M channels into ideal signals for each sound source which are signals indicating components of each sound source on the basis of a sound source direction indicated by the sound source direction information. The sound source separation unit 103 uses, for example, a geometric-constrained high-order decorrelation-based source separation (GHDSS) method at the time of separating the ideal signals into ideal signals for each sound source. The sound source separation unit 103 calculates spectrums of the separated ideal signals and outputs them to the speech zone detection unit 104.

The speech zone detection unit 104 acquires the sound source direction information output by the sound source localization unit 102 and the spectrums of ideal signals output by the sound source localization unit 102. The speech zone detection unit 104 detects a speech zone for each sound source on the basis of the acquired spectrums of separated acoustic signals and the acquired sound source direction information. For example, the speech zone detection unit 104 performs sound source detection and speech zone detection at the same time by performing threshold processing on an integrated spatial spectrum obtained by integrating spatial spectrums obtained for each frequency using the MUSIC method in the frequency direction. The speech zone detection unit 104 outputs a result of the detection, the direction information, and the spectrums of acoustic signals to the feature amount extraction unit 105.

The feature amount extraction unit 105 calculates an acoustic feature amount for acoustic recognition from the separated spectrums output by the speech zone detection unit 104 for each sound source. The feature amount extraction unit 105 calculates an acoustic feature amount by calculating, for example, a static mel-scale log spectrum (MSLS), a delta MSLS and one delta power for each predetermined time (for example, 10 ms). Note that the MSLS is obtained by performing an inverse discrete cosine conversion on a mel-frequency cepstrum coefficient (MFCC) using a spectrum feature amount as a feature amount of acoustic recognition. The feature amount extraction unit 105 outputs the obtained acoustic feature amount to the sound source identification unit 107.

The acoustic model storage unit 106 stores a sound source model. The sound source model is a model used by the sound source identification unit 107 to identify collected acoustic signals. The acoustic model storage unit 106 sets an acoustic feature amount of the acoustic signals to be identified as a sound source model and stores it in association with information indicating a sound source name for each sound source.

The sound source identification unit 107 identifies a sound source with reference to an acoustic model stored by the acoustic model storage unit 106, which indicates an acoustic feature amount output by the feature amount extraction unit 105.

Since the sound source identification device 100 configured in this manner includes the acoustic signal output device 1, it is possible to suppress an increase in errors of the identification of a sound source that are errors caused by the fact that all of the microphones 11-*m* are not located at the same position.

<Description of Spectrum Expansion Matrix and Steering Vector Using Mathematical Expression>

Hereinafter, a spectrum expansion matrix and a steering vector will be described according to a mathematical expression.

First, the spectrum expansion matrix will be described.

The spectrum expansion matrix is, for example, a function satisfying the following expression (4).

$$X_n = A_n X_{ideal} \tag{4}$$

In Expression (4), $A_n$ represents the spectrum expansion matrix. The spectrum expansion matrix $A_n$ in Expression (4) represents conversion from a spectrum $X_{ideal}$ of an ideal signal to a spectrum $X_n$ of a time domain digital signal $Yall_n$. Note that n is an integer of 1 or more and M or less.

Since the spectrum $X_n$ and the spectrum $X_{ideal}$ of an ideal signal are vectors, $A_n$ is a matrix.

$A_n$ satisfies a relationship of Expression (5).

$$A_n = DB_n D^{-1} \tag{5}$$

Expression (5) shows that $A_n$ is a value obtained by applying a discrete Fourier transform matrix D from a left side and an inverse matrix of the discrete Fourier transform matrix D from a right side to a resampling matrix $B_n$.

The resampling matrix $B_n$ is a matrix which converts a single frame time domain digital signal $Y_{ideal}$ into a single frame time domain digital signal $Y_n$. To represent this using a mathematical expression, the resampling matrix $B_n$ is a matrix satisfying a relationship of the following Expression (6). The single frame time domain digital signal $Y_{ideal}$ is a signal of the frame g of the ideal signal.

$$Y_n = B_n Y_0 \tag{6}$$

The value at row θ and column φ of the resampling matrix $B_n$ is set to $B_{n,\theta,\varphi}$ (θ and φ are integers of 1 or more), and $B_{n,\theta,\varphi}$ satisfies a relationship of the following Expression (7).

$$b_{n,\theta,\phi} = \mathrm{sinc}\left(\frac{\pi}{\omega_{\mu}}(\theta \cdot \omega_n + (\tau_n - \tau_{ideal}) - \phi \cdot \omega_{ideal})\right) \tag{7}$$

In Expression (7), $\omega_n$ represents a sampling frequency in a channel n. The channel n is an $n^{th}$ channel among a plurality of channels. In Expression (7), $\tau_n$ represents a sample time in the channel n.

The function sin c ( . . . ) appearing on the right side of Expression (7) is a function defined by the following Expression (8). In Expression (8), t is an arbitrary number.

$$\mathrm{sinc}(t) = \frac{\sin(t)}{t} \tag{8}$$

The relationships represented by Expression (6) to Expression (8) are expressions known to be established between the single frame time domain digital signal $Y_n$ and the single frame time domain digital signal $Y_{ideal}$.

Next, the steering vector will be described.

To simply the following description, a steering vector in a frequency bin f will be described. The steering vector in the frequency bin f is a function $R_f$ satisfying the following Expression (9). The steering vector $R_f$ in the frequency bin f is a vector having M elements.

$$(\chi_{1,f}, \ldots, \chi_{M,f})^T = R_f s_f \tag{9}$$

In Expression (9), $s_f$ represents a spectrum intensity of a sound source in the frequency bin f. In Expression (9), $\chi_{m,f}$ is a spectrum intensity in the frequency bin f of a frequency spectrum of the analog signal $Z2_m$ sampled at the virtual frequency $\omega_{ideal}$.

Hereinafter, vectors $(\chi_{1,f}, \ldots, \chi_{M,f})$ on the left side in Expression (9) are referred to as a simultaneous observation spectrum $E_f$ at the frequency bin f.

Here, a vector $E_{all}$ in which the simultaneous observation spectrum $E_f$ throughout the frequency bin f is integrated is defined. Hereinafter, $E_{all}$ is referred to as an entire simultaneous observation spectrum. The entire simultaneous observation spectrum $E_{all}$ is a direct product of $E_f$ in all frequency bins f. Specifically, the entire simultaneous observation spectrum $E_{all}$ is represented by Expression (10).

Hereinafter, it is assumed that f is an integer of 0 or more and (F−1) or less, and the total number of frequency bins is F to simplify the description.

$$E_{all} \equiv \begin{pmatrix} \chi_{1,0} \\ \vdots \\ \chi_{M,0} \\ \vdots \\ \chi_{1,F-1} \\ \vdots \\ \chi_{M,F-1} \end{pmatrix} \tag{10}$$

The entire simultaneous observation spectrum $E_{all}$ satisfies relationships of the following Expression (11) and Expression (12).

$$E_{all} \equiv \begin{pmatrix} \chi_{1,0} \\ \vdots \\ \chi_{M,0} \\ \vdots \\ \chi_{1,F-1} \\ \vdots \\ \chi_{M,F-1} \end{pmatrix} = \begin{pmatrix} r_{1,0}s_0 \\ \vdots \\ r_{M,0}s_0 \\ \vdots \\ r_{1,F-1}s_{F-1} \\ \vdots \\ r_{M,F-1}s_{F-1} \end{pmatrix} = \begin{pmatrix} R_0 & & \\ & \ddots & \\ & & R_{F-1} \end{pmatrix} S \tag{11}$$

$$S \equiv (s_0, \ldots, s_{F-1})^T \tag{12}$$

Hereinafter, S defined in Expression (12) is referred to as a sound source spectrum. In Expression (11), $r_{m,f}$ is an $m^{th}$ element value of the steering vector $R_f$.

Alternatively, a relationship of the following Expression (14) is established for a modified simultaneous observation spectrum $H_m$ defined by Expression (13) in which an order of subscripts of x is switched according to Expression (11).

$$H_m = (\chi_{m,0}, \ldots, \chi_{m,F-1})^T \tag{13}$$

$$\begin{pmatrix} H_1 \\ \vdots \\ H_M \end{pmatrix} = \begin{pmatrix} r_{1,0} & & & & & \\ & \ddots & & & & \\ & & r_{1,F-1} & & & \\ & & \vdots & & & \\ r_{M,0} & & & & & \\ & \ddots & & & & \\ & & r_{M,F-1} & & & \end{pmatrix} S \tag{14}$$

Here, if a permutation matrix P of (M×F) rows and (M×F) columns having an element value p_<$k_x$,$k_y$> is used, Expression (14) is modified to the following Expression (15). Note that $k_x$ and $k_y$ are integers of 1 or more and (M×F) or less.

$$\begin{pmatrix} H_1 \\ \vdots \\ H_M \end{pmatrix} = P \begin{pmatrix} R_0 & & \\ & \ddots & \\ & & R_{F-1} \end{pmatrix} S \tag{15}$$

The element p_<$k_x$,$k_y$> at row $k_x$ and column $k_y$ of P is 1 when $k_x$ and $k_y$ satisfying the following Expression (16) and Expression (17) are present, and is 0 when they are not present.

$$k_x = f \times M + (m-1) + 1 \tag{16}$$

$$k_y = f + (m-1) \times M + 1 \tag{17}$$

The permutation matrix P is, for example, the following Expression (18) when M is 2 and F is 3.

$$P = \begin{pmatrix} 1 & 0 & 0 & 0 & 0 & 0 \\ 0 & 0 & 1 & 0 & 0 & 0 \\ 0 & 0 & 0 & 0 & 1 & 0 \\ 0 & 1 & 0 & 0 & 0 & 0 \\ 0 & 0 & 0 & 1 & 0 & 0 \\ 0 & 0 & 0 & 0 & 0 & 1 \end{pmatrix} \tag{18}$$

P is a unitary matrix. In addition, a determinant of P is +1 or −1.

Here, a relationship between a sound source spectrum s and the spectrum $X_m$ will be described.

Hereinafter, the relationship between the sound source spectrum s and the spectrum $X_m$ in a spectrum expansion model will be described.

In the spectrum expansion and contraction model, a situation in which each microphone 11-*m* performs sampling at a different sampling frequency is considered. In the spectrum expansion and contraction model, it is assumed that conversion of a sampling frequency is performed independently using each microphone 11-*m*, and thus it does not affect a transmission system. Note that a spatial correlation matrix in this situation is a spatial correlation matrix when each microphone 11-*m* performs synchronous sampling at the virtual frequency $\omega_{ideal}$.

A relationship of the following Expression (19) is established between the modified simultaneous observation spectrum $H_m$ and the spectrum $X_m$ according to Expression (4).

$$\begin{pmatrix} X_1 \\ \vdots \\ X_M \end{pmatrix} = \begin{pmatrix} A_1 & & \\ & \ddots & \\ & & A_M \end{pmatrix} \begin{pmatrix} H_1 \\ \vdots \\ H_M \end{pmatrix} \tag{19}$$

If Expression (15) is substituted into Expression (19), Expression (20) which represents a relationship between the sound source spectrum s and the spectrum $X_m$ is derived.

$$\begin{pmatrix} X_1 \\ \vdots \\ X_M \end{pmatrix} = \begin{pmatrix} A_1 & & \\ & \ddots & \\ & & A_M \end{pmatrix} P \begin{pmatrix} R_1 & & \\ & \ddots & \\ & & R_{F-1} \end{pmatrix} S \tag{20}$$

<Description of Evaluation Condition Using Mathematical Expression>

An example of evaluation condition will be described using a mathematical expression.

The evaluation condition may be, for example, a condition that all of differences between values obtained by dividing the element $\chi_{m,f}$ of the simultaneous observation $E_f$ by the element value $r_{m,f}$ of the steering vector $R_f$ are within a predetermined range when the following three incidental conditions are satisfied.

A first incidental condition is, for example, a condition that a probability distribution of possible values for the sampling frequency $\omega_m$ is a normal distribution having a dispersion $\sigma_\omega^2$ centered about the virtual frequency $\omega_{ideal}$.

A second incidental condition is a condition that a probability distribution of possible values for the sample time $\tau_m$ is a normal distribution having a dispersion $\sigma_\tau^2$ centered about the virtual time $\tau_{ideal}$.

A third incidental condition is a condition that possible values of each element value of the simultaneous observation spectrum $E_f$ have a probability distribution represented by a likelihood function p of the following Expression (21).

$$p(X_1, \ldots X_M \mid \omega_m, \tau_m) \equiv \frac{1}{M\sigma^2}\left\|\sum_{m=1}^{M}\frac{A_m^{-1}X_m}{r_m}\right\|_2^2 \tag{21}$$

In Expression (21), σ represents a dispersion of a spectrum in a process in which a sound source spectrum is observed using each microphone 11-*m*. In Expression (21), $A_m^{-1}$ represents an inverse matrix of a spectrum expansion matrix $A_m$.

Expression (21) is a function having a maximum value when a sound source is set to white noise, and when the sampling frequency $\omega_m$ is all the same, the sample time $\tau_m$ is all the same, and the microphones 11-*m* are located at the same position. When the sound source is white noise and the value of Expression (21) becomes maximum, a value obtained by dividing an element value of the simultaneous observation spectrum in each frame g and each frequency bin f by an element value of the steering vector in each frame g and each frequency bin f coincides with the sound source spectrum. Specifically, a relationship of Expression (22) is established.

$$\frac{X_{1,f}}{r_{1,f}} = \ldots = \frac{X_{M,f}}{r_{M,f}} = s_f \tag{22}$$

An evaluation condition may be in a form of using a sum of L1 norms (absolute values) instead of a sum of norms (squares of absolute values) in Expression (21) as a third incidental condition. In addition, the evaluation condition may be in a form of defining a likelihood function using a cosine similarity degree of each term in Expression (22).

Here, the steering vector and the spectrum expansion matrix in the embodiment will be described with reference to FIG. 5.

Figure 5:
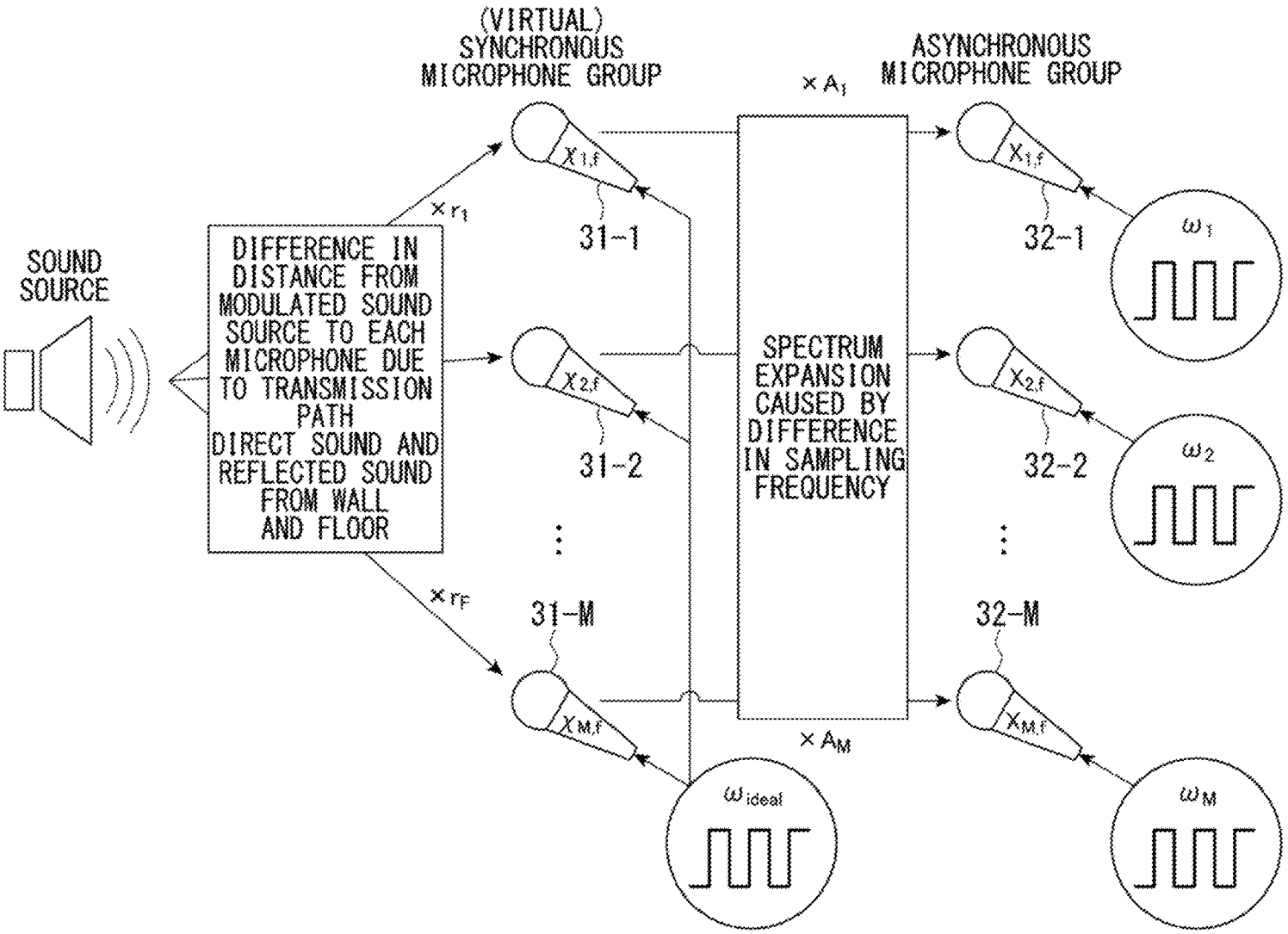
FIG. 5 is an explanatory diagram which describes a steering vector and a spectrum expansion matrix in the embodiment.

FIG. 5 is an explanatory diagram which describes the steering vector and the spectrum expansion matrix in the embodiment.

In FIG. 5, sounds emitted from a sound source are collected by a (virtual) synchronous microphone group.

The (virtual) synchronous microphone group includes a plurality of virtual synchronous microphones 31-*m*. The virtual synchronous microphones 31-*m* in FIG. 5 are virtual microphones which include AD converters and convert collected sounds into digital signals. All of the virtual synchronous microphones 31-*m* include a common oscillator and have the same sampling frequency. The sampling frequency of all of the virtual synchronous microphones 31-*m* is $\omega_{ideal}$. The virtual synchronous microphones 31-*m* are located differently in a space.

In FIG. 5, an asynchronous microphone group includes a plurality of asynchronous microphones 32-*m*. The asynchronous microphones 32-*m* include oscillators. The oscillators provided in the asynchronous microphones 32-*m* are independent from each other. For this reason, sampling frequencies of the asynchronous microphones 32-*m* are not necessarily the same. The sampling frequencies of the asynchronous microphones 32-*m* are $\omega_m$. Positions of the asynchronous microphones 32-*m* are the same as those of the virtual synchronous microphones 31-*m*.

Sounds emitted from a sound source are modulated due to a transmission path until they reach each virtual synchronous microphone 31-*m*. The sounds collected by each virtual synchronous microphone 31-*m* are affected by a difference between the virtual synchronous microphones 31-*m* in a distance from the sound source to each virtual synchronous microphone 31-*m*, and differs from one another for each virtual synchronous microphone 31-*m*. The sounds collected by each virtual synchronous microphone 31-*m* are direct sounds and reflected sounds from walls or floors, and direct sounds and reflected sounds reaching each virtual synchronous microphone differ in accordance with a difference of a position of each microphone.

Such a difference in modulation due to the transmission path for each virtual synchronous microphone 31-*m* is represented by a steering vector. In FIG. 5, $r_1, \ldots, r_M$ are element values of the steering vector, and represents modulation which the sounds emitted by the sound source are subjected to until they are collected by the virtual synchronous microphones 31-*m* due to the transmission path of the sounds.

The sampling frequencies of the asynchronous microphones 32-*m* are not necessarily the same as $\omega_{ideal}$. For this reason, a frequency component of a digital signal by the virtual synchronous microphone 31-*m* and a frequency component of a digital signal by the asynchronous microphone 32-*m* are not necessarily the same. The spectrum expansion matrix represents a change in digital signal caused by such a difference in sampling frequency.

$x_{m,f}$ represents a spectrum intensity of the spectrum $X_m$ at the frequency bin f.

Experimental Result

FIGS. 6 to 13 are simulation results which indicate a corresponding relationship between the virtual frequency and virtual time acquired by the acoustic signal processing unit 22 in the embodiment and actual sampling frequency and sample time. FIGS. 6 to 13 are first to eighth diagrams that show simulation results.

FIGS. 6 to 13 are experimental results of experiments using two microphones with an interval of 20 cm.

That is, the simulation results in FIGS. 6 to 13 are experimental results in a case in which M is 2. FIGS. 6 to 13 are experimental results in a case in which there is one sound source. FIGS. 6 to 13 are experimental results of experiments when the sound source is on a line connecting two microphones and the sound source is located at a distance of 1 m from a center of the line connecting two microphones. FIGS. 6 to 13 are experimental results of experiments in which the sampling frequency in a calculation of the steering vector is 16 kHz, the number of samples in the Fourier transform is 512, and the sound source is white noise.

In FIGS. 6 to 13, the horizontal axis represents a sampling frequency on, and the vertical axis represents a sampling frequency on.

FIGS. 6 to 13 show a combination of the sampling frequency on and the sampling frequency $\omega_2$, which maximizes a posteriori probability acquired by the acoustic signal processing unit 22 when the sampling frequencies on and on are changed every 10 Hz between 15900 Hz to 16100 Hz.

In FIGS. 6 to 13, the sampling frequency on is a sampling frequency for a sound collected by a microphone close to the sound source. In FIGS. 6 to 13, the sampling frequency $\omega_2$ is a sampling frequency for a sound collected by a microphone far from the sound source. Note that the sample time $\tau_m$ in the simulations indicating simulation results in FIGS. 6 to 13 is 0.

Figure 6:
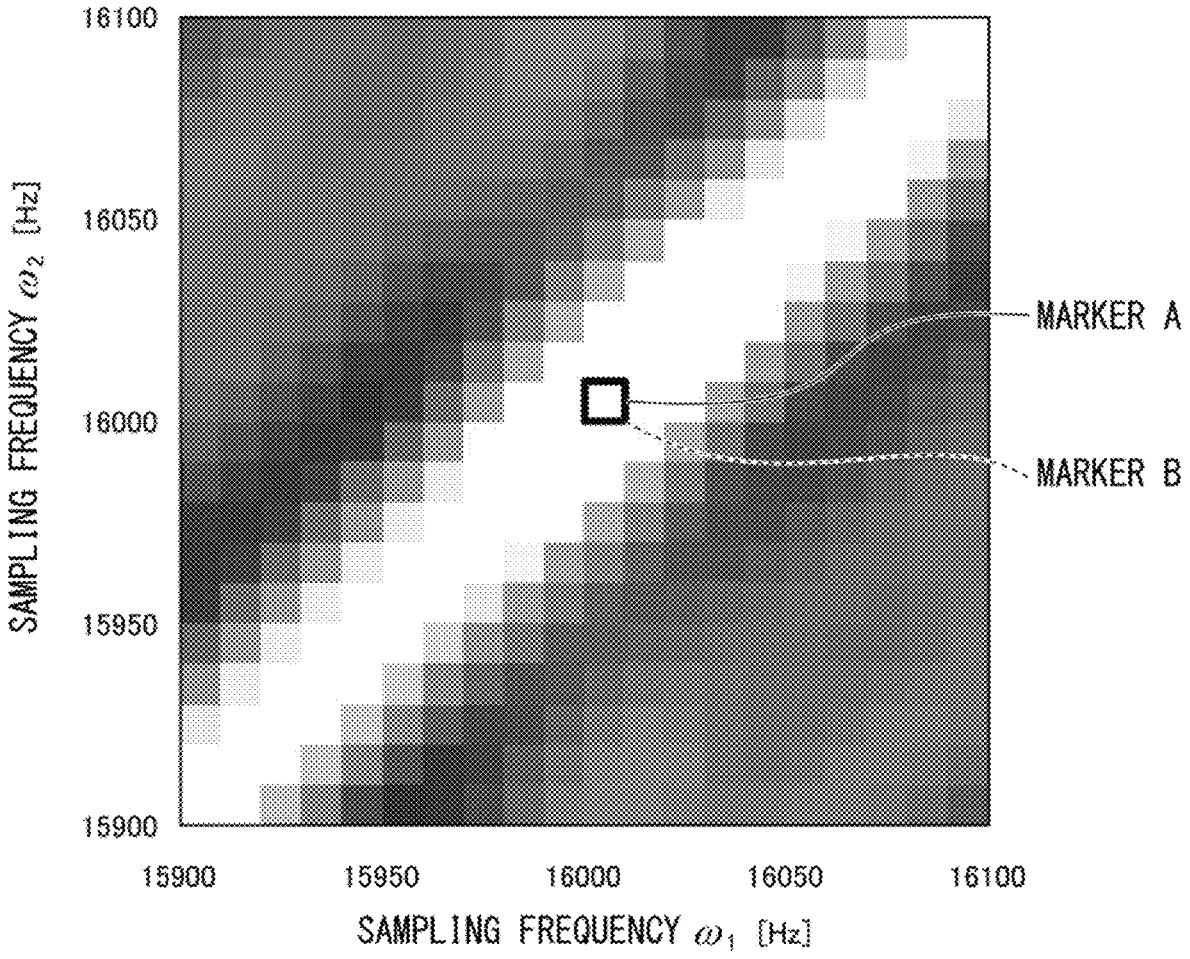
FIG. 6 is a first diagram which shows simulation results.

In FIG. 6, a marker A indicating the combination of the sampling frequencies on and on of a microphone in the simulation and a marker B indicating the combination of the sampling frequencies $\omega_1$ and $\omega_2$, which maximizes a posteriori probability indicated by the simulation results, coincide with each other.

FIG. 6 shows that both of the sampling frequencies $\omega_1$ and $\omega_2$ which maximize the posteriori probability indicated by the simulation results are 16000 Hz when both of the sampling frequencies $\omega_1$ and $\omega_2$ of a microphone in the simulation are set to 16000 kHz.

Figure 7:
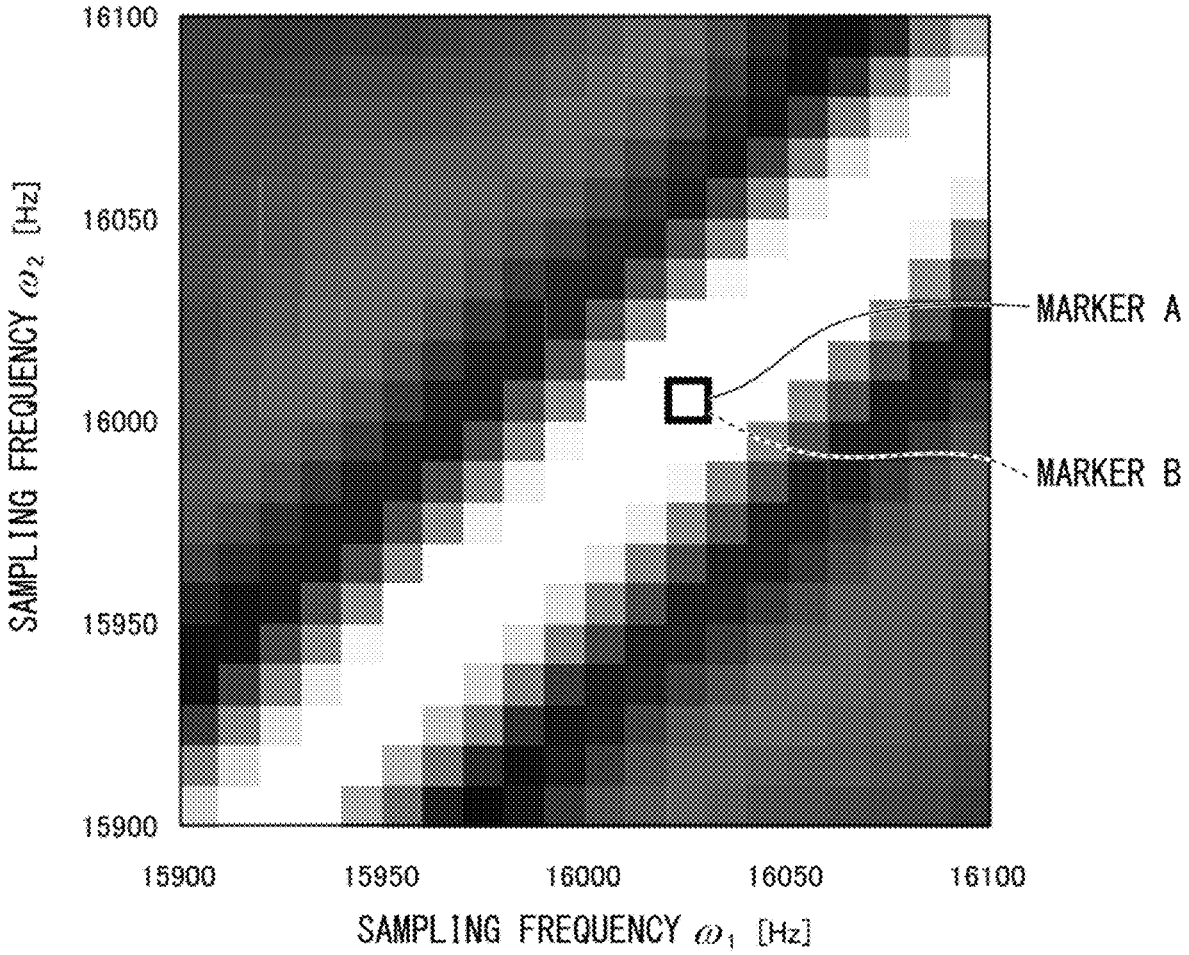
FIG. 7 is a second diagram which shows simulation results.

In FIG. 7, the marker A indicating the combination of the sampling frequencies $\omega_1$ and $\omega_2$ of a microphone in the simulation and the marker B indicating the combination of the sampling frequencies $\omega_1$ and $\omega_2$, which maximizes a posteriori probability indicated by the simulation results, coincide with each other.

FIG. 7 shows that both of the sampling frequencies $\omega_1$ and $\omega_2$ which maximize the posteriori probability indicated by the simulation results are 16020 Hz when both of the sampling frequencies $\omega_1$ and $\omega_2$ of a microphone in the simulation are set to 16020 kHz.

Hereinafter, values of the sampling frequencies $\omega_1$ and $\omega_2$ of a microphone in the simulation are referred to as true values.

FIGS. 6 and 7 shows that the values of the sampling frequencies $\omega_1$ and $\omega_2$ which maximize the posteriori probability coincide with the true values. For this reason, FIGS. 6 and 7 shows that the acoustic signal processing unit 22 can acquire a virtual frequency and a virtual time with high accuracy.

Figure 8:
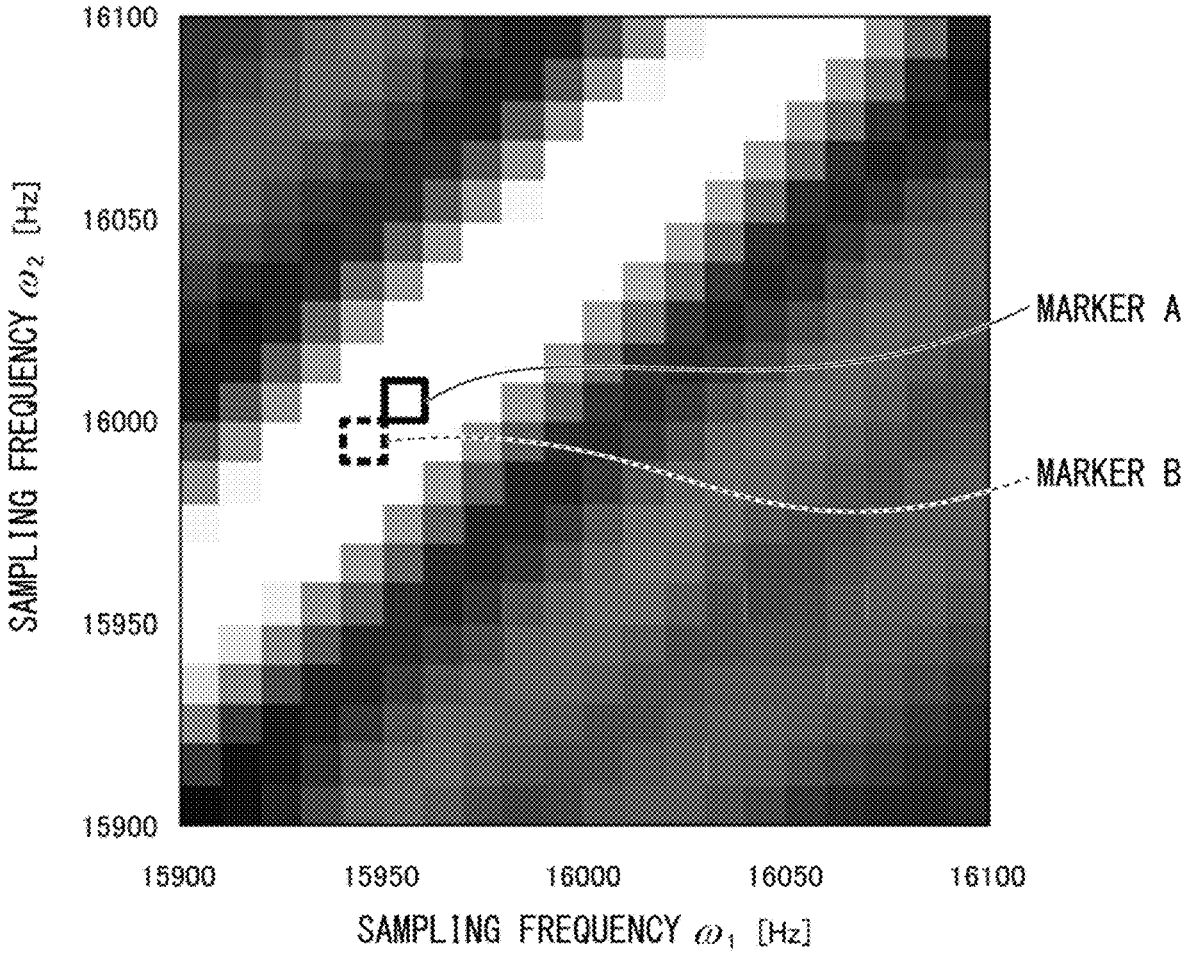
FIG. 8 is a third diagram which shows simulation results.

In FIG. 8, the marker A indicating the true value and the marker B indicating the combination of the sampling frequencies $\omega_1$ and $\omega_2$ maximizing a posteriori probability indicated by the simulation results are close to each other even though they do not coincide with each other.

The marker B of FIG. 8 indicates the combination of the sampling frequencies $\omega_1$ and $\omega_2$ maximizing a posteriori probability indicated by the simulation results when the true value of the sampling frequency $\omega_2$ is 16000 Hz and the true value of the sampling frequency $\omega_1$ is 15950 Hz.

Figure 9:
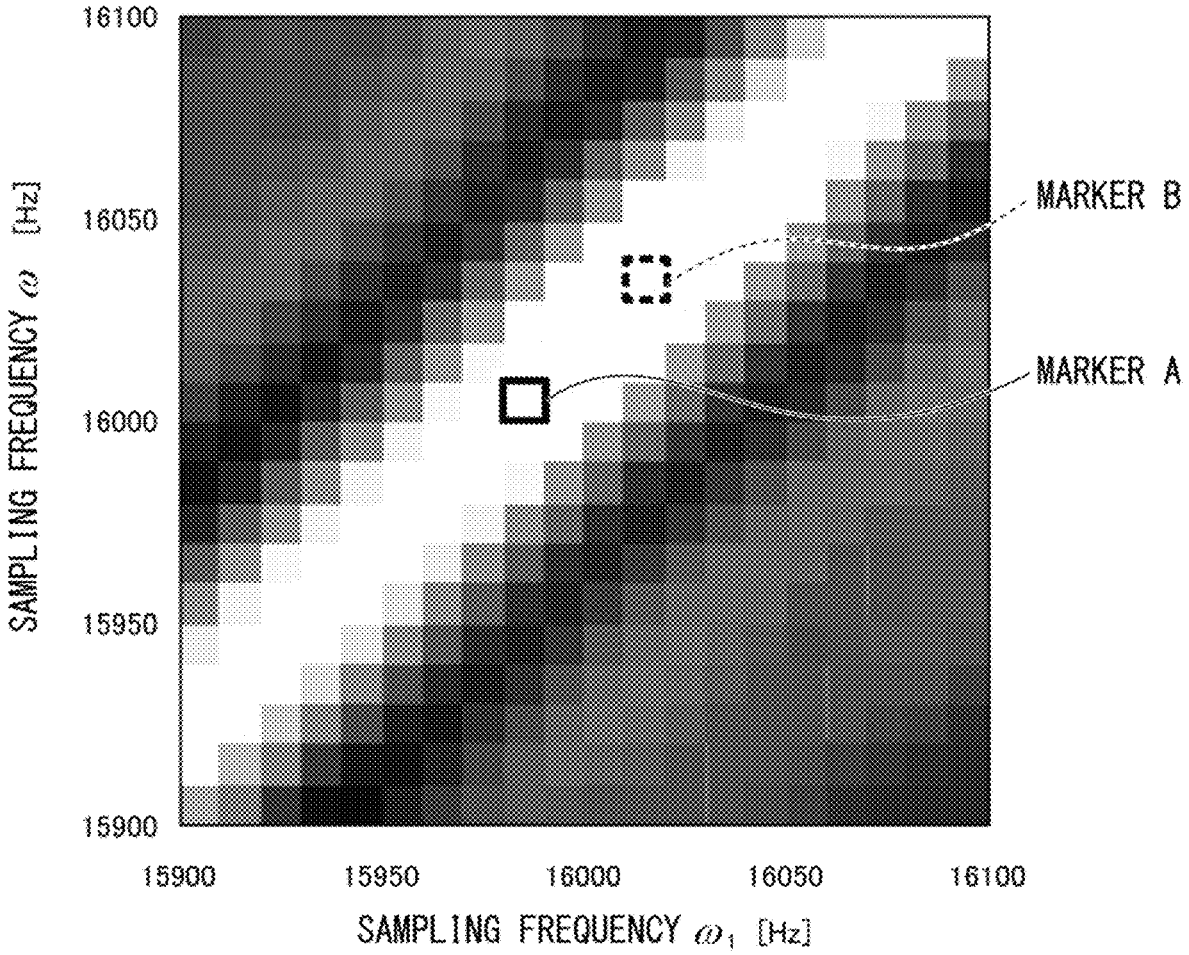
FIG. 9 is a fourth diagram which shows simulation results.

In FIG. 9, the marker A indicating the true value and the marker B indicating the combination of the sampling frequencies $\omega_1$ and $\omega_2$ maximizing a posteriori probability indicated by the simulation results are less likely to coincide with each other.

The marker B of FIG. 9 indicates the combination of the sampling frequencies $\omega_1$ and $\omega_2$ maximizing a posteriori probability indicated by the simulation results when the true value of the sampling frequency $\omega_2$ is 16000 Hz and the true value of the sampling frequency $\omega_1$ is 15980 Hz.

Figure 10:
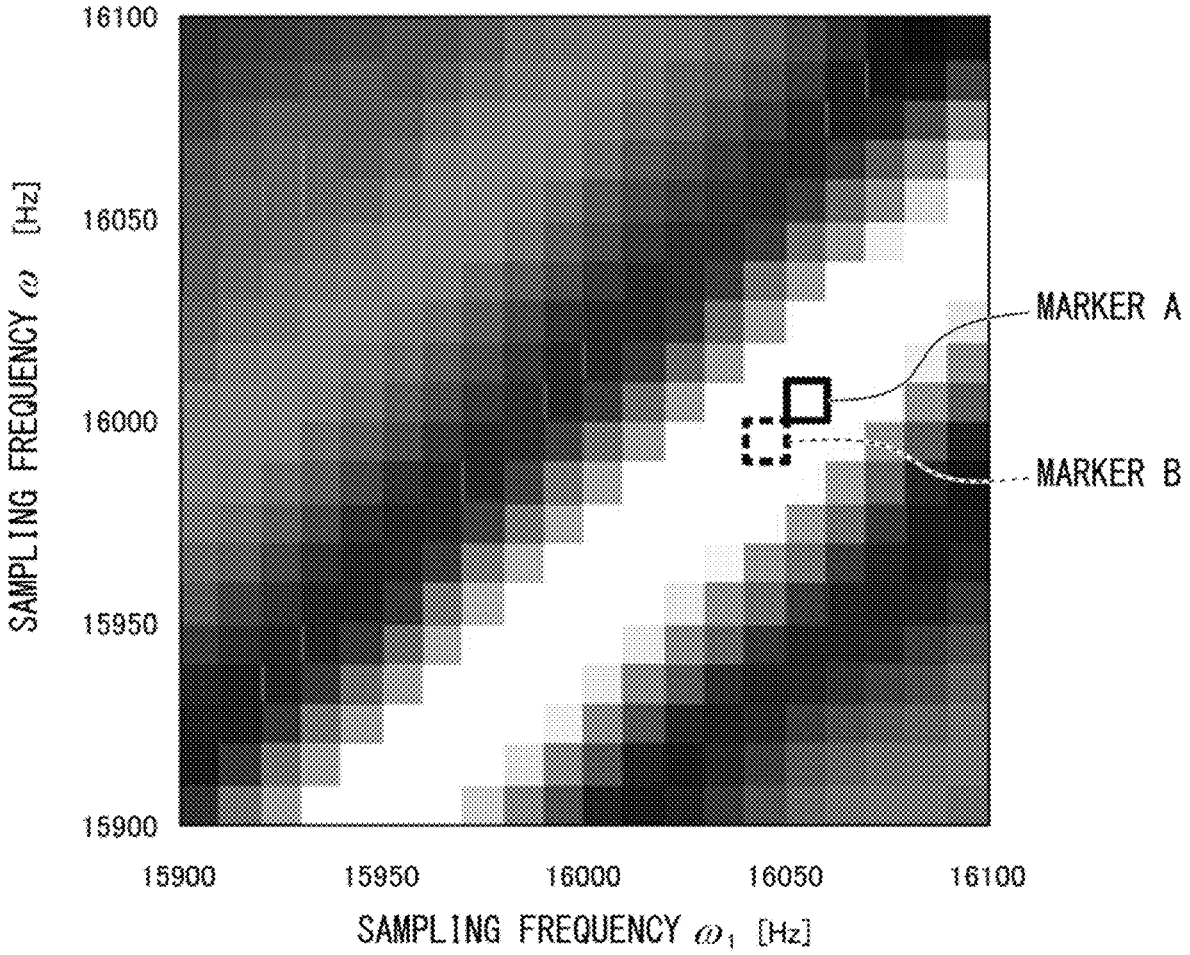
FIG. 10 is a fifth diagram which shows simulation results.

In FIG. 10, the marker A indicating the true value and the marker B indicating the combination of the sampling frequencies $\omega_1$ and $\omega_2$ maximizing a posteriori probability indicated by the simulation results are less likely to coincide with each other.

The marker B of FIG. 10 indicates the combination of the sampling frequencies $\omega_1$ and $\omega_2$ maximizing a posteriori probability indicated by the simulation results when the true value of the sampling frequency $\omega_2$ is 16000 Hz and the true value of the sampling frequency $\omega_1$ is 16050 Hz.

Figure 11:
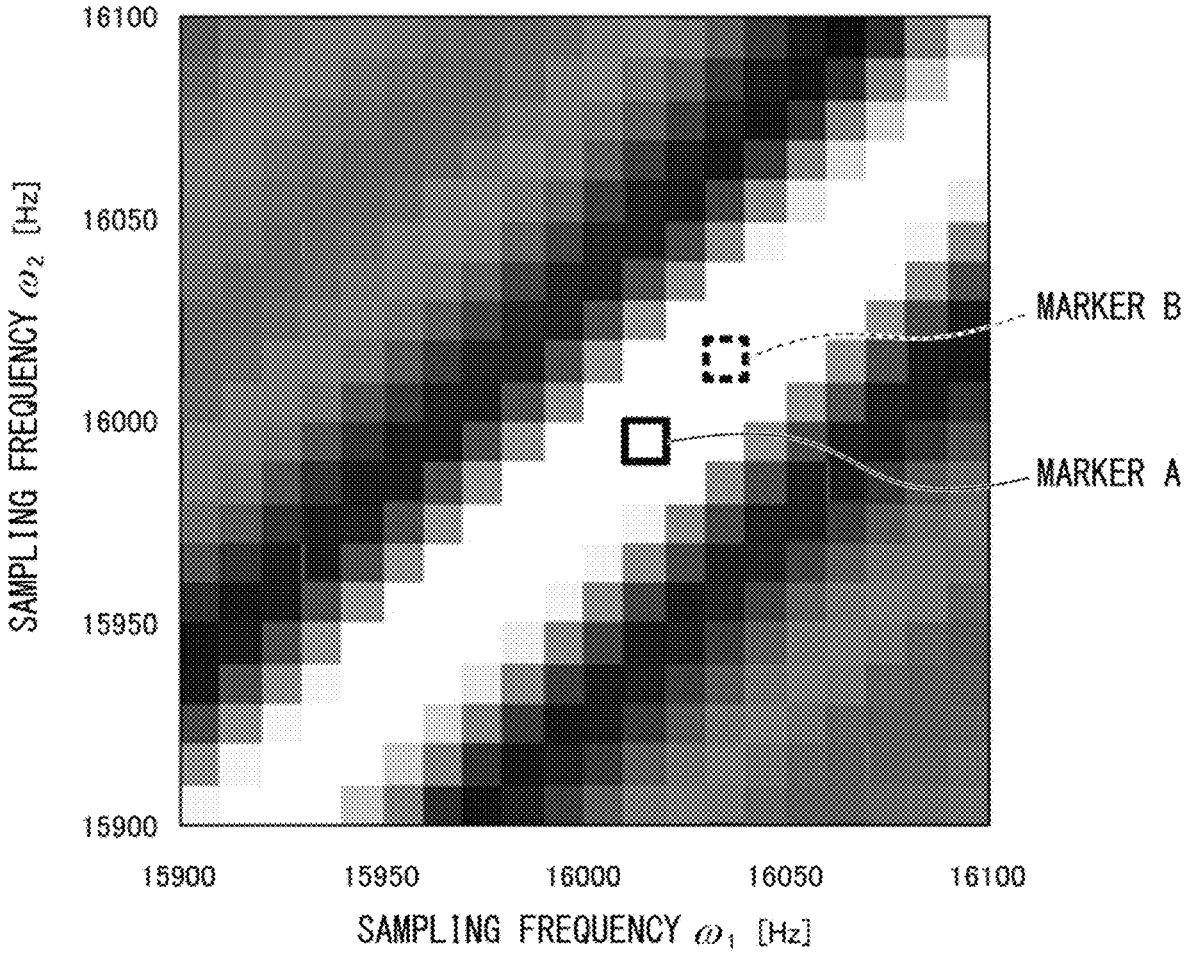
FIG. 11 is a sixth diagram which shows simulation results.

In FIG. 11, the marker A indicating the true value and the marker B indicating the combination of the sampling frequencies $\omega_1$ and $\omega_2$ maximizing a posteriori probability indicated by the simulation results are less likely to coincide with each other.

The marker B of FIG. 11 indicates the combination of the sampling frequencies $\omega_1$ and $\omega_2$ maximizing a posteriori probability indicated by the simulation results when the true value of the sampling frequency $\omega_2$ is 15990 Hz and the true value of the sampling frequency $\omega_1$ is 16010 Hz.

Figure 12:
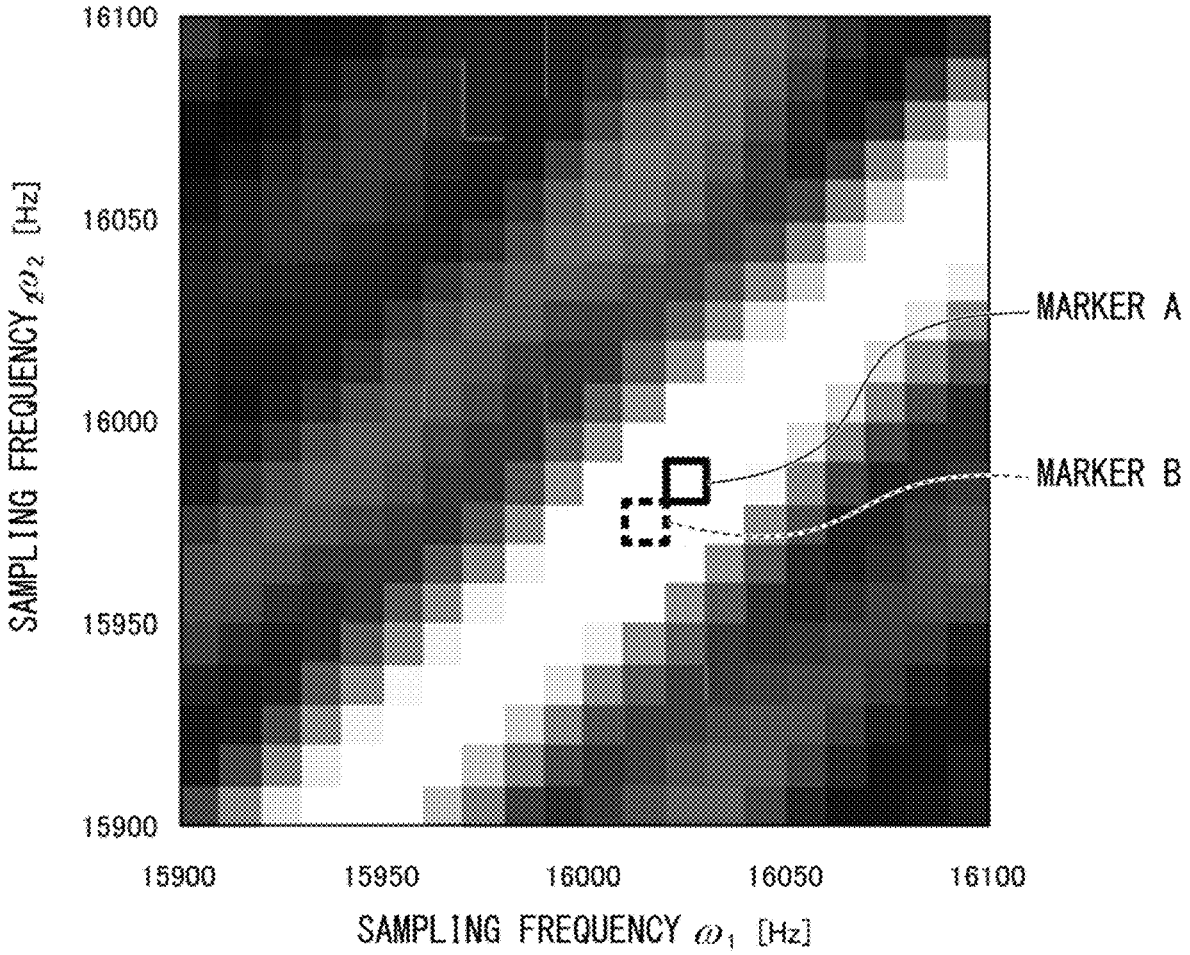
FIG. 12 is a seventh diagram which shows simulation results.

In FIG. 12, the marker A indicating the true value and the marker B indicating the combination of the sampling frequencies $\omega_1$ and $\omega_2$ maximizing a posteriori probability indicated by the simulation results are less likely to coincide with each other.

The marker B of FIG. 12 indicates the combination of the sampling frequencies $\omega_1$ and $\omega_2$ maximizing a posteriori probability indicated by the simulation results when the true value of the sampling frequency $\omega_2$ is 15980 Hz and the true value of the sampling frequency $\omega_1$ is 16020 Hz.

Figure 13:
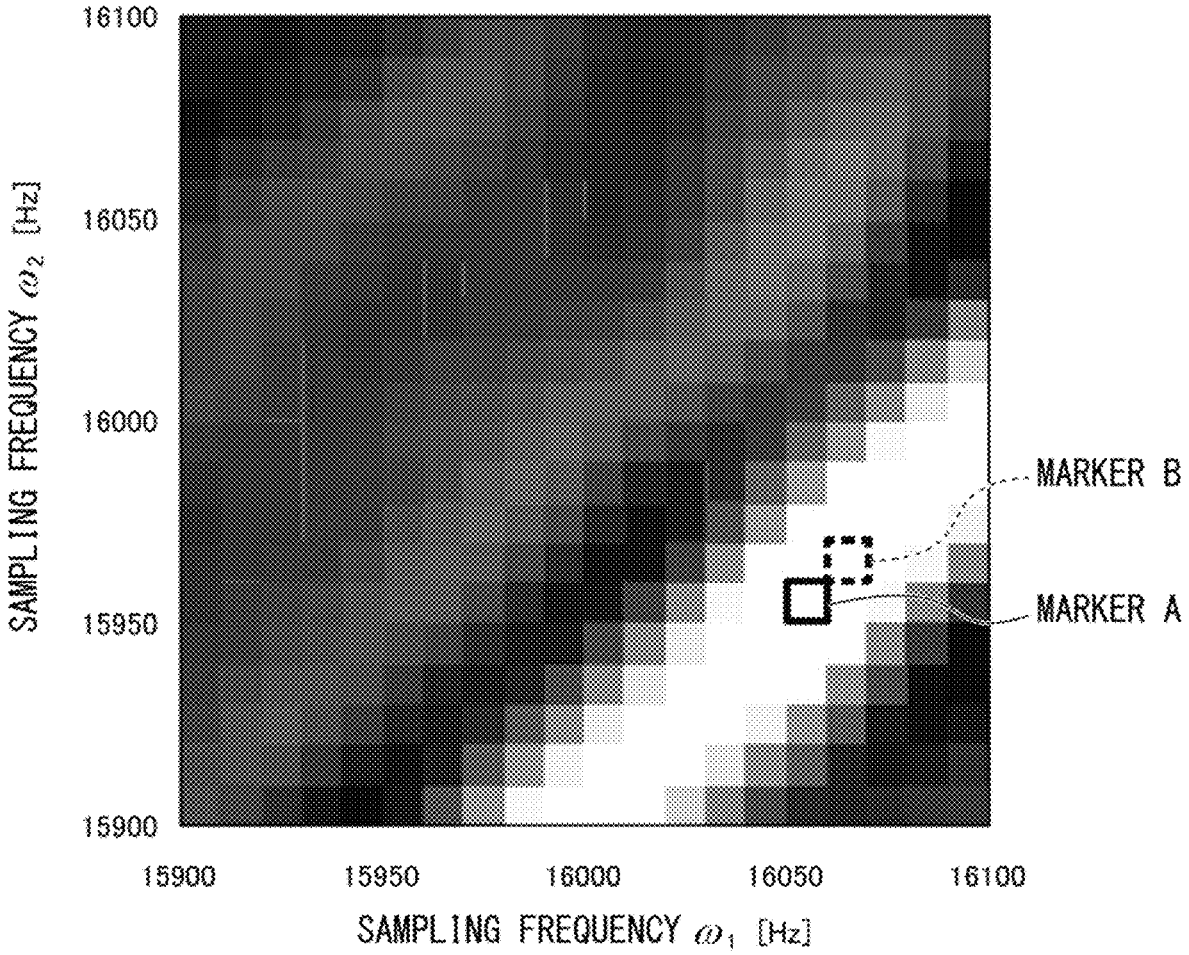
FIG. 13 is an eighth diagram which shows simulation results.

In FIG. 13, the marker A indicating the true value and the marker B indicating the combination of the sampling frequencies $\omega_1$ and $\omega_2$ maximizing a posteriori probability indicated by the simulation results are less likely to coincide with each other.

The marker B of FIG. 13 indicates the combination of the sampling frequencies $\omega_1$ and $\omega_2$ maximizing a posteriori probability indicated by the simulation results when the true value of the sampling frequency $\omega_2$ is 15950 Hz and the true value of the sampling frequency $\omega_1$ is 16050 Hz.

In FIG. 8, the sampling frequency $\omega_1$ maximizing the posteriori probability is 15960 Hz, the sampling frequency $\omega_2$ maximizing the posteriori probability is 16010 Hz, the true value of the sampling frequency $\omega_1$ is 15950 Hz, and the true value of the sampling frequency $\omega_2$ is 16000 Hz. For this reason, in FIG. 8, a difference between the sampling frequency $\omega_1$ maximizing the posteriori probability and the sampling frequency $\omega_2$ maximizing the posteriori probability is equal to a difference between the true value of the sampling frequency $\omega_1$ and the true value of the sampling frequency $\omega_2$.

This is because, even if the acoustic signal processing unit 22 does not acquire the sampling frequencies $\omega_1$ and $\omega_2$ that maximize the posteriori probability and equal to the true values, the result of FIG. 8 shows that the acoustic signal processing unit 22 acquires a reasonable combination of sampling frequencies to a certain extent.

Note that the posteriori probability is a product of a distribution of the sampling frequency $\omega_m$, which is assumed in advance before simulation results are acquired, and a probability of the simulation results. The distribution of the sampling frequency $\omega_m$, which is assumed in advance before simulation results are acquired, is, for example, a normal distribution. The probability of the simulation results is, for example, a likelihood function represented by Expression (21).

Modified Example

Note that the AD conversion unit 21-1 is not necessarily required to be included in the acoustic signal processing device 20, and may be included in the microphone array 10. In addition, the acoustic signal processing device 20 is not necessarily mounted on one case, and may be a device configured to be divided into a plurality of cases. In addition, the acoustic signal processing device 20 may be a device configured in a single case, or may be a device configured to be divided into a plurality of cases. When it is configured to be divided into a plurality of cases, a function of a part of the acoustic signal processing device 20 described above may be mounted at physically separated positions via a network. The acoustic signal output device 1 may also be a device configured in a single case or a device configured to be divided into a plurality of cases. When it is configured to be divided in a plurality of cases, the function of a part of the acoustic signal output device 1 may also be mounted on physically separated positions via the network.

Note that all or a part of respective functions of the acoustic signal output device 1, the acoustic signal processing device 20, and the sound source identification device 100 may be realized by using hardware such as an application specific integrated circuit (ASIC), a programmable logic device (PLD), or a field programmable gate array (FPGA). A program may be recorded in a computer-readable recording medium. The computer-readable recording medium is, for example, a portable disk such as a flexible disk a magneto-optical disc, a ROM, or a CD-ROM, or a storage device such as a hard disk built in a computer system. The program may be transmitted via an electric telecommunication line.

As described above, the embodiment of the present invention has been described in detail with reference to the drawings, but a specific configuration is not limited to this embodiment, and design and the like within a range not departing from the gist of the present invention can be included.

What is claimed is:

1. An acoustic signal processing device comprising:

an acoustic signal processing unit configured to calculate a spectrum of each acoustic signal and a steering vector having m elements on the basis of m acoustic signals converted into m digital signals by sampling m analog signals representing sounds collected by m microphones (m is an integer of 1 or more and M or less, and M is an integer of 2 or more) and to estimate a sampling frequency ω.sub.m in the sampling on the basis of the spectrum, the steering vector, and a sampling frequency ω.sub.ideal that is a predetermined value;

wherein the steering vector represents a difference between positions of the microphones having a transfer characteristic from a sound source of the sounds to each of the microphones.

2. The acoustic signal processing device according to claim 1, wherein a matrix representing a conversion of an analog signal from a spectrum of an ideal signal into a spectrum of a signal sampled at the sampling frequency $\omega_m$ and a sample time $\tau_m$ is set to a spectrum expansion matrix, and the acoustic signal processing unit estimates the sampling frequency $\omega_m$ on the basis of the steering vector, the spectrum expansion matrix, and a spectrum $X_m$.

3. An acoustic signal processing method comprising:

a spectrum calculation step of calculating a spectrum of each acoustic signal on the basis of m acoustic signals converted into m digital signals by sampling m analog signals representing sounds collected by m microphones (m is an integer of 1 or more and M or less, and M is an integer of 2 or more);

a steering vector calculation step of calculating a steering vector having m elements on the basis of the m converted acoustic signals; and an estimation step of estimating a sampling frequency ω.sub.m in the sampling on the basis of the spectrum, the steering vector, and a sampling frequency ω.sub.ideal that is a predetermined value;

wherein the steering vector represents a difference between positions of the microphones having a transfer characteristic from a sound source of the sounds to each of the microphones.

4. A computer readable non-transitory storage medium which stores a program causing a computer of an acoustic signal processing device to execute:

a spectrum calculation step of calculating a spectrum of each acoustic signal on the basis of m acoustic signals converted into m digital signals by sampling m analog signals representing sounds collected by m microphones (m is an integer of 1 or more and M or less, and M is an integer of 2 or more);

a steering vector calculation step of calculating a steering vector having m elements on the basis of the m converted acoustic signals; and an estimation step of estimating a sampling frequency ω.sub.m in the sampling on the basis of the spectrum, the steering vector, and a sampling frequency ω.sub.ideal that is a predetermined value;

wherein the steering vector represents a difference between positions of the microphones having a transfer characteristic from a sound source of the sounds to each of the microphones.

* * * * *